US011718454B1

(12) United States Patent
Stoneberg et al.

(10) Patent No.: US 11,718,454 B1
(45) Date of Patent: Aug. 8, 2023

(54) FLOW CONTROL CLOSURE

(71) Applicant: Phoenix Closures, Inc., Naperville, IL (US)

(72) Inventors: Thomas Stoneberg, Buffalo Grove, IL (US); Ryan Joseph Magee, Buffalo Grove, IL (US)

(73) Assignee: Phoenix Closures, Inc., Naperville, IL (US)

( * ) Notice: Subject to any disclaimer, the term of this patent is extended or adjusted under 35 U.S.C. 154(b) by 0 days.

(21) Appl. No.: 17/664,733

(22) Filed: May 24, 2022

(51) Int. Cl.
*B65D 43/16* (2006.01)
*B65D 47/08* (2006.01)

(52) U.S. Cl.
CPC ..... *B65D 47/0838* (2013.01)

(58) Field of Classification Search
CPC ..... B65D 47/0838; B65D 47/0804
See application file for complete search history.

(56) References Cited

U.S. PATENT DOCUMENTS 2,103,111 A * 12/1937 Ekdahl ..... B65D 35/38 222/545
6,454,130 B1 * 9/2002 Miller ..... B65D 47/0814 222/94
2006/0213934 A1 * 9/2006 Uytterhaeghe .... B65D 47/0809 222/546
2006/0243759 A1 * 11/2006 King ..... B65D 35/28 222/548
2007/0199962 A1 * 8/2007 Mengeu ..... B65D 47/265 222/548
2014/0263324 A1 * 9/2014 Latham ..... B65D 55/16 220/259.3
2019/0177044 A1 * 6/2019 Beringer ..... B65D 41/3428
2021/0107709 A1 * 4/2021 Garcia Alberola ..... B65D 47/0838

FOREIGN PATENT DOCUMENTS

DE 202009000138 * 3/2009 ..... B65D 47/0838
WO WO-2012131097 A1 * 10/2012 ..... B65D 47/0838

* cited by examiner

*Primary Examiner* — Bob Zadeh
(74) *Attorney, Agent, or Firm* — Husch Blackwell LLP

(57) ABSTRACT

A flow control closure is provided. The closure having a body member with a base wall, a body skirt, and a spout extending from the base wall away from the body skirt; a lid member with a top wall and a lid skirt, the lid member being movable between an open position and a closed position, the top wall having a seal positioned to engage the spout when the lid member is in the closed position; and a hinge member that joins the lid member with the body member. The spout can include an orifice with an outer profile having a first diameter and an inner profile having a second diameter, the orifice can include one or more uvulas that partially obstructs the first diameter. The flow control closure can be molded as one unitary piece.

16 Claims, 9 Drawing Sheets

FLOW CONTROL CLOSURE

BACKGROUND OF THE INVENTION

Many different kinds of packaged products, such as food, beverages and pharmaceuticals, can be dispensed from a container. Certain products, such as condiments, can be difficult to dispense depending on their properties.

Due to viscosity and other properties, controlling flow of a product can also be challenging. For example, it can be desirable be able to more precisely control a flow of a product such as salad dressing or ketchup, such that a dish is not overly doused in said product. As such, there is a need for a closure that can provide enhanced flow control for dispensing a product.

Similarly, it can also be desirable to be able to more accurately control a location for dispensing, such that a product is only dispensed to a desired area, such as a specific region on a plate. As such, there is also a need for a closure that can provide precision dispensing when dispensing a product.

Moreover, multicomponent closures can be cumbersome to assemble and be less user and environmentally friendly. For example, at screw cap can easily be misplaced or lost. Thus, there is a need to create a closure as a singular unit that is preferably fully recyclable.

SUMMARY OF THE INVENTION

This disclosure generally relates to a closure. More specifically, the disclosure relates to a closure with enhanced flow control suitable for use with a bottle, a jar, a container, or the likes.

An aspect of this disclosure relates to a closure including: a body member comprising a base wall, a body skirt, and a spout extending from the base wall away from the body skirt; a lid member comprising a top wall and a lid skirt, the lid member being movable between an open position and a closed position, the top wall having a seal positioned to engage the spout when the lid member is in the closed position; and a hinge member that joins the lid member with the body member, wherein the base wall includes a back portion proximal to the hinge member and a front portion distal from the hinge member, the spout includes an orifice positioned toward the front portion, away from the back portion, and toward a top rim of the spout.

Another aspect of this disclosure relates to an orifice including an outer profile having a first diameter and an inner profile having a second diameter that is different from the first diameter; the orifice includes at least one uvula, and the first diameter of the orifice being partially obstructed by the at least one uvula.

A further aspect of this disclosure relates to a guide lug on the lid member positioned to align the lid member with the body member when the lid member transitions from the open position to the closed position. The guide lug includes a horizontal surface that is parallel to the top wall, wherein the horizontal surface of the guide lug is positioned to contact the top rim of the spout when the lid member transitions from the open position to the closed position.

An additional aspect of this disclosure relates to the spout extending from the base wall from a middle portion of the base wall to the front portion of the base wall, the spout is skewed funnel shaped with the orifice biased toward the front portion of the base wall.

Yet another aspect of this disclosure relates to the lid member, the body member, and the hinge member being molded as one unitary piece.

Figure 1:
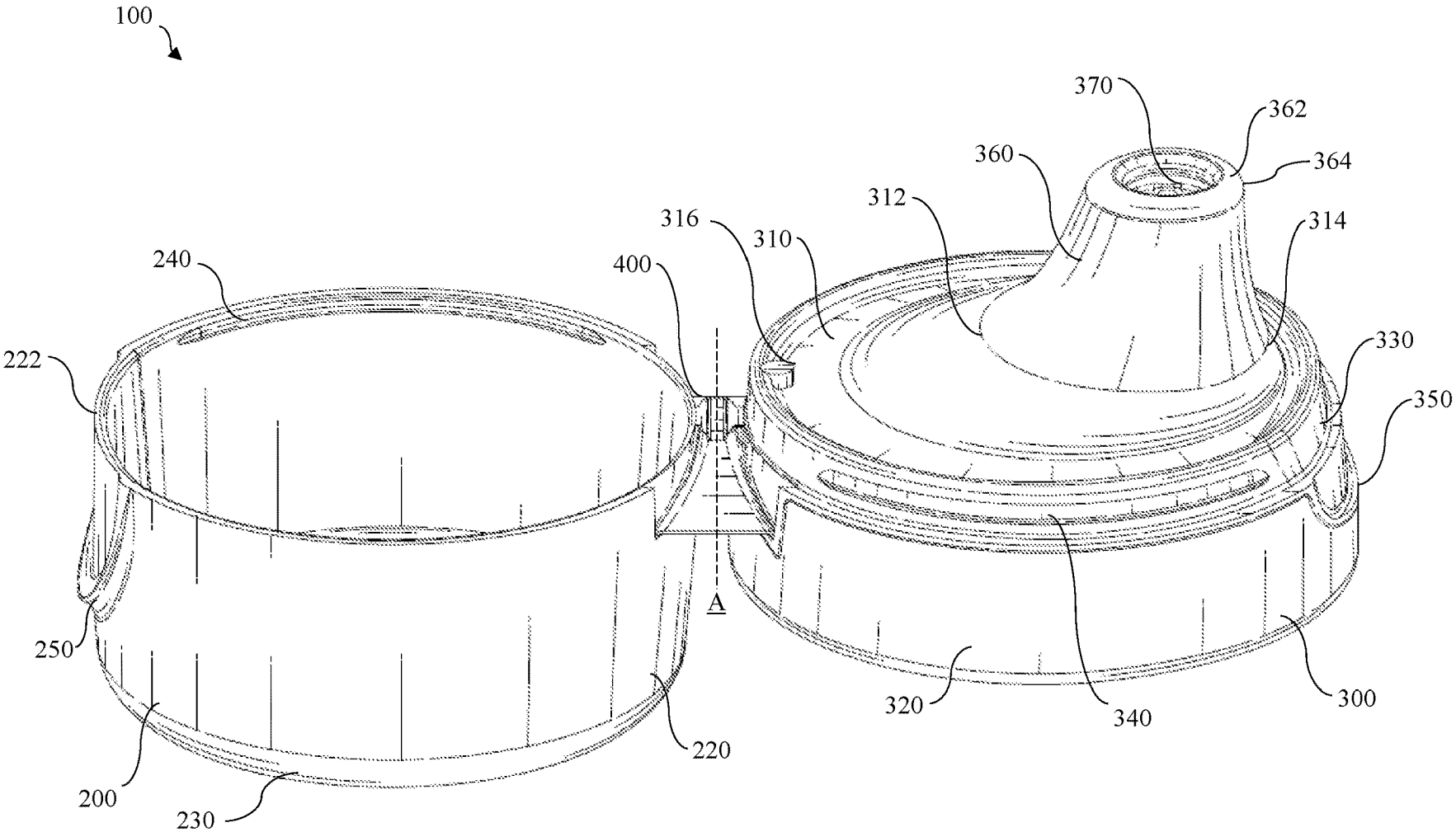
FIG. 1 illustrates a side view of a flow control closure according to an exemplary embodiment.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

While this invention is susceptible of embodiments in many different forms, there are shown in the drawings and will be described in detail herein specific embodiments with the understanding that the present disclosure is an exemplification of the principles of the invention. It is not intended to limit the invention to the specific illustrated embodiments. The features of the invention disclosed herein in the description, drawings, and claims can be significant, both individually and in any desired combinations, for the operation of the invention in its various embodiments. Features from one embodiment can be used in other embodiments of the invention.

Figure 2:
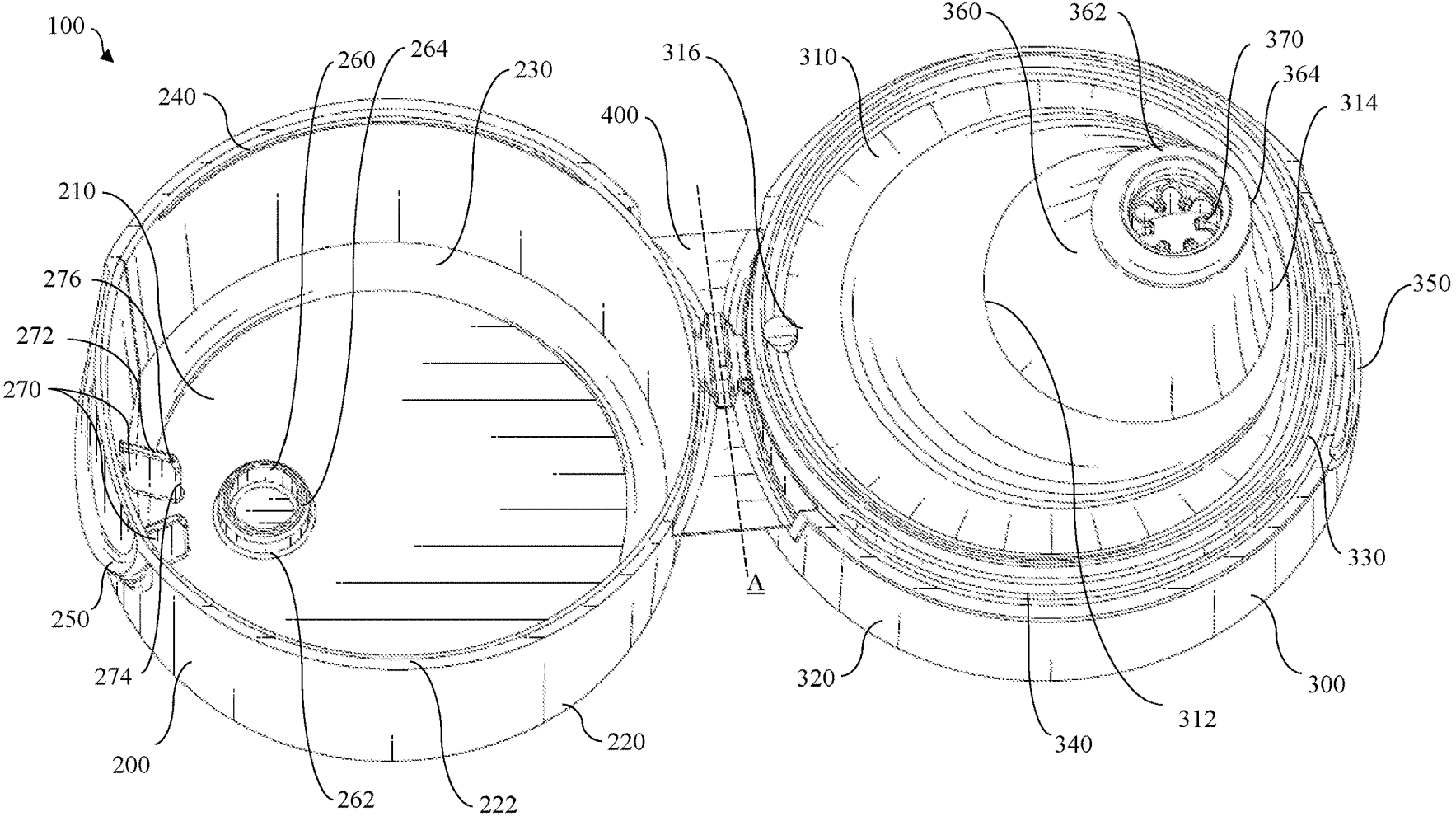
FIG. 2 illustrates a perspective view of the flow control closure of FIG. 1.
Figure 3:
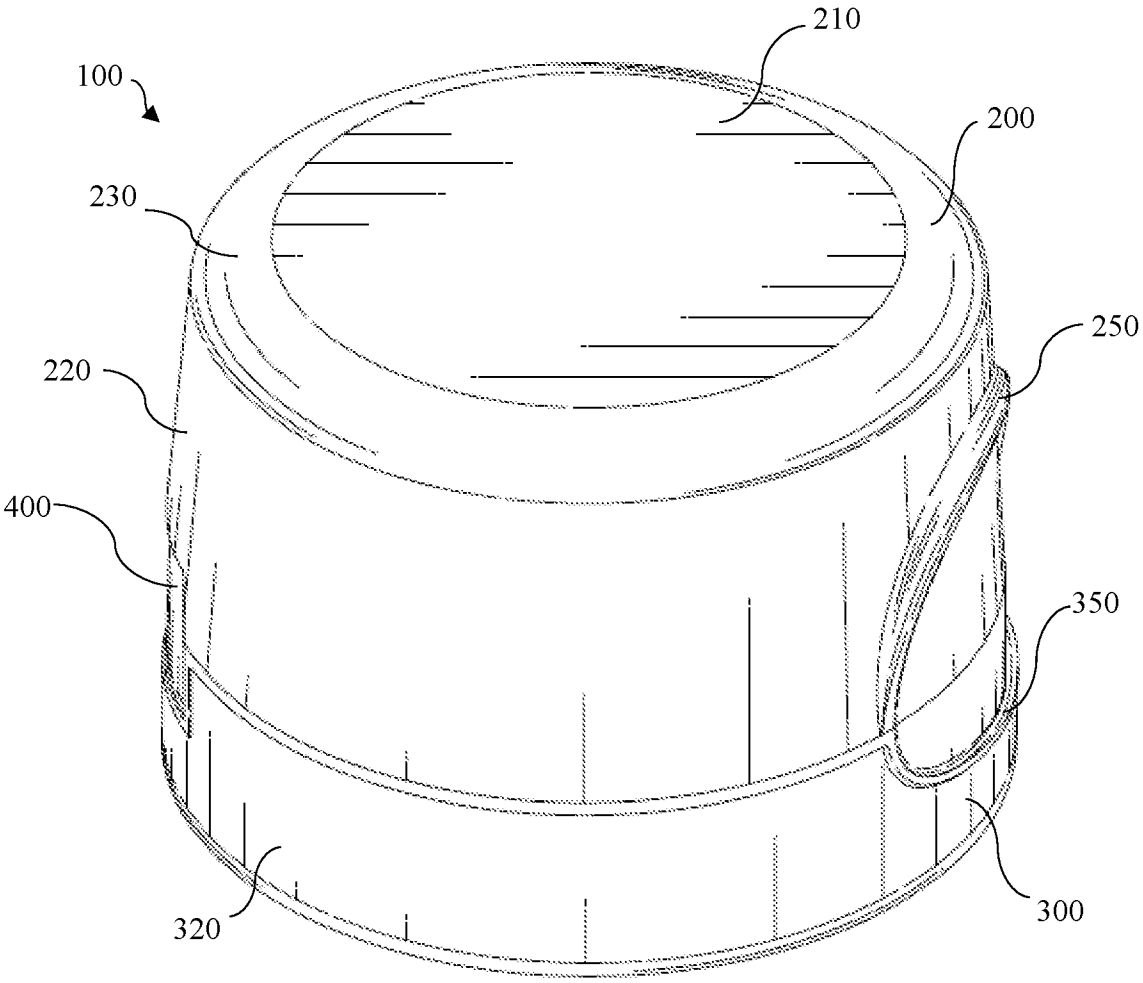
FIG. 3 illustrates a closed configuration of the flow control closure of FIG. 1.

As shown in FIGS. 1-8, the embodiments of this disclosure include a closure 100. The closure 100 can include a lid member 200 and a body member 300. A hinge member 400 can be provided to join the lid member 200 to the body member 300 and enables the lid member 200 to reversibly move between an open position (as shown in FIGS. 1-2 and 5-6) for dispensing a flowable material into or out of a container and a closed position (as shown in FIG. 3) for securing the contents of the container.

The lid member 200 can include a top wall 210, a lid skirt 220 that forms a side wall for the lid member 200, and a lid shoulder 230 at the juncture of the top wall 210 and the lid skirt 220. One or more first engaging beads 240 can be provided on an interior surface of the lid skirt 220 to be mated with a corresponding second engaging beads 340 on the body member 300 to secure the closure 100 in the closed position. Moreover, one or more top ledges 250 can be provided on an exterior surface of the lid skirt 220. The top ledge 250 can allow a user to open the closure 100 from the closed position with greater ease. For example, by pushing a finger against the top ledge 250 upwards to open the lid member 200 away from the body member 300.

A seal 260 can further be provided in an interior surface of the top wall 210 that extends from a top edge 262 to a bottom edge 264. In an embodiment, the seal 260 can take a form of a mono seal.

One or more guide lugs 270 can also be provided in an interior of the lid member 200. In an embodiment, the guide lugs 270 can protrude from an interior surface along the top wall 210, the lid shoulder 230, and the lid skirt 220. As shown in FIG. 2, each guide lug 270 can include a horizontal surface 272 that is parallel with the top wall 210 and a vertical surface 274 that is parallel with the lid skirt 220. A transitional surface 276 can be provided between the horizontal surface 272 and the vertical surface 274 such that the horizontal surface 272 does not transition into the vertical surface 274 in a right angle. The transitional surface 276 can be a flat surface at an angle relative to the horizontal surface 272 and the vertical surface 274. Alternatively, the transitional surface 276 can be a curved surface that transitions the horizontal surface 272 into the vertical surface 274. The guide lugs 270 can be used to provide an alignment feature that aids the lid member 200 in engaging the body member 300 when the closure 100 transitions from the open position to the closed position.

The body member 300 can engage the closure 100 to a container. The body member 30 can include a base wall 310 and a body skirt 320 with a body shoulder 330 at the junction of the base wall 310 and the body skirt 320. One or more second engaging beads 340 can be provided on an exterior surface of the body shoulder 330 that can be mated with the first engaging beads 240 of the lid member 200 when the closure 100 is in the closed position. In some embodiments, the second engaging beads 340 can be provided on an exterior surface of the body skirt 320 instead of or in addition to being provided on the body shoulder 330. One or more threads 380 can be provided on an interior surface of the body skirt 320 (see FIGS. 8A-8D), which can be mated with corresponding engaging beads on a container or on a neck of the container. Alternatively, the body member 300 can engage the container through other means such as through a snug fit. Further, a second wall can be provided on the body member 300 to create a double-wall configuration. In the double-wall configuration, the threads 380 can be provided on the second wall, and the second wall can engage the container instead of the body skirt 320.

One or more bottom ledges 350 can be provided on an exterior surface of the body skirt 320. The bottom ledge 350 can allow the user to open the closure 100 from the closed position with greater ease in conjunction with the top ledge 250 of the lid member 200. For example, the user can hold the container while resting a thumb on the bottom ledge 350 on one hand and presses the thumb of the other hand against the top ledge 250 to open the lid member 200 away from the body member 300 by applying forces toward generally opposite directions.

Figure 4:
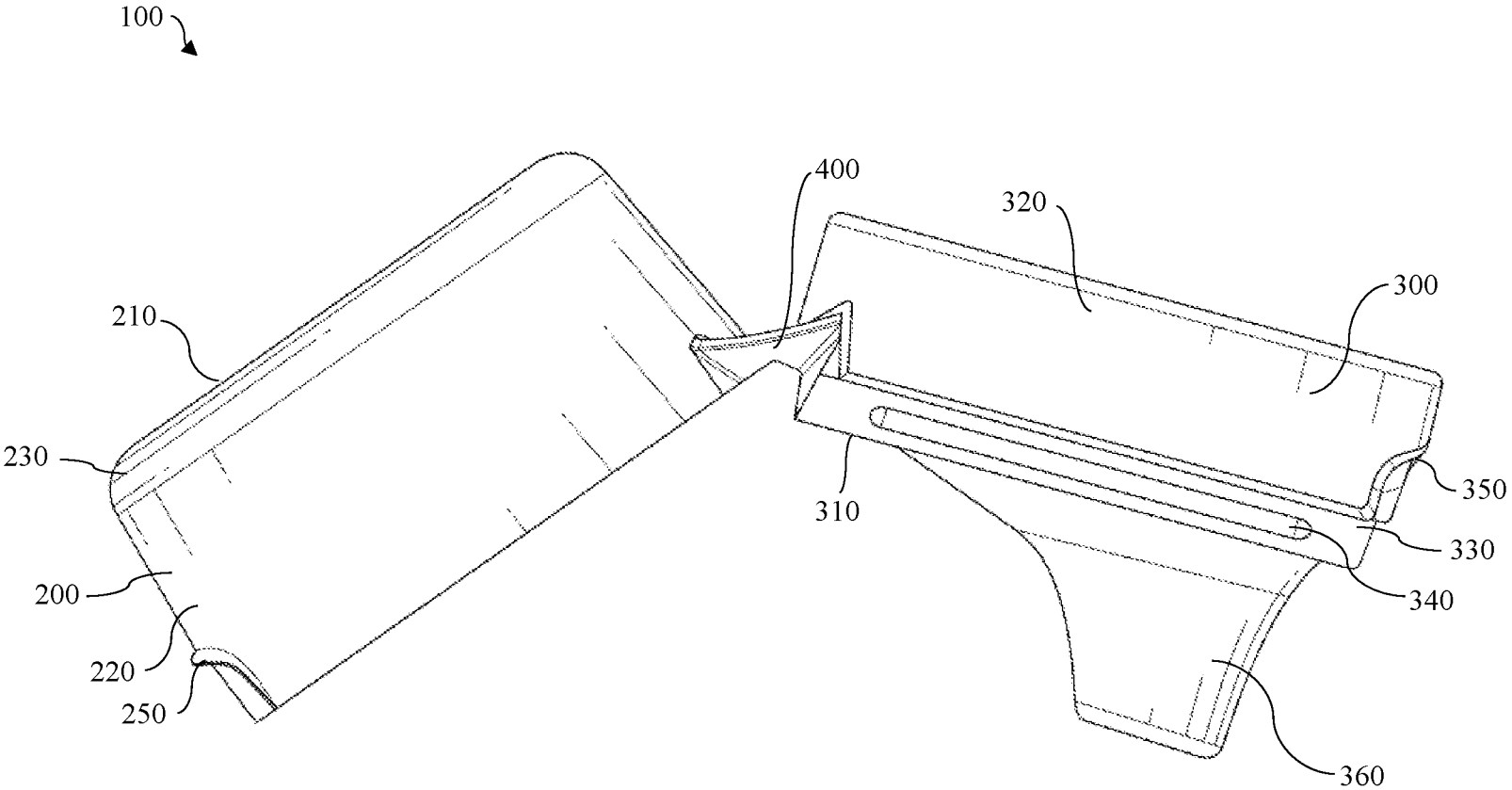
FIG. 4 illustrates an as-used configuration of the flow control closure of FIG. 1.
Figure 5:
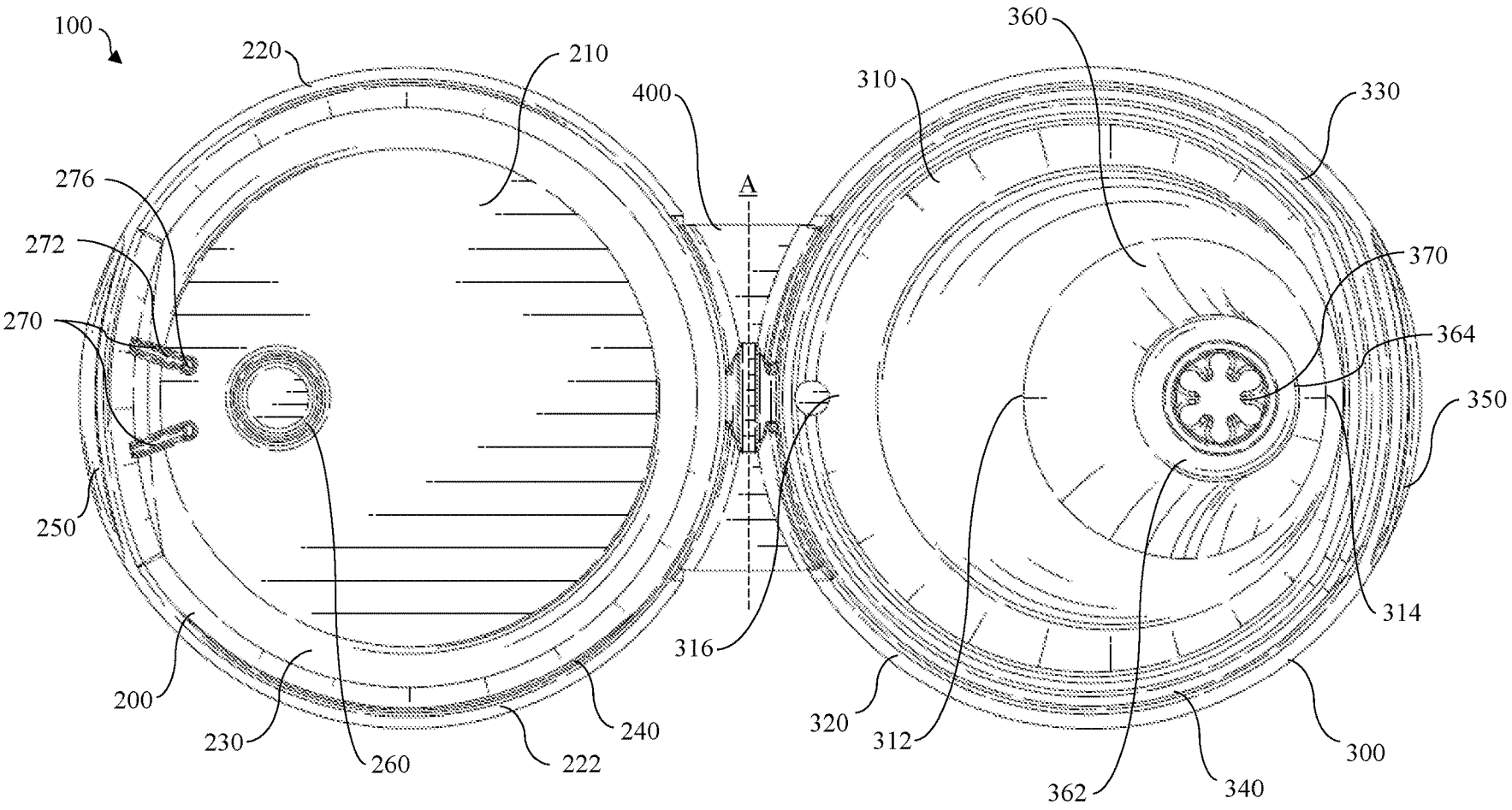
FIG. 5 illustrates a top view of the flow control closure of FIG. 1.

A spout 360 can extend from a middle portion 312 of the base wall 310 and can include an orifice 370 having a noncircular opening 371 for dispensing. In some embodiments, the spout 360 can be a funnel in shape. In some embodiments, the middle portion 312 that the spout 360 extends from can be a center of the base wall 310. In further embodiments, the spout 360 can be the shape of a skewed funnel, biased toward a front portion 314 of the base wall 310. For reference, a back portion 316 of the base wall 310 is also shown on FIGS. 1-2 and 5-6. In some embodiments, the spout 360 can extend and skew toward a front half of the base wall 310. In further embodiments, the spout 360 can extend and skew toward a front third of the base wall 310. In yet further embodiments, the sprout 360 can extend and skew toward a front quarter of the base wall 310. The forward bias of the sprout 360 can allow the orifice 370 to be further away from the lid member 200 when the closure 100 is in the open position. When the closure 100 is attached to a container and flipped upside-down for dispensing, the lid member 200 can drape lower and results in an intermediate position or an as-used position as shown in FIG. 4. The forward bias of the spout 360 can reduce an encroachment from the lid member 200 when the orifice 370 is being used to dispense a product.

The orifice 370 can be elevated away from a horizontal plane defined by a bottom edge 222 of the lid member 200 formed by the lid skirt 220 as shown in FIG. 1. In some embodiments, the horizontal plane defined by a bottom edge 222 of the lid member 200 can be lower than a horizontal plane defined by the base wall 310 such that the entire lid member 200 is positioned lower than the base wall 310 when the closure 100 is in the open position. In some embodiments, a first height of the spout 360 can be at least 25% of a second height of the lid skirt 220. In further embodiments, the first height of the spout 360 can be at least 50% of the second height of the lid skirt 220. In yet further embodiments, the first height of the spout 360 can be at least 75% of the second height of the lid skirt 220. Moreover, the orifice 370 can be positioned slightly below a rim 362 of the spout 360. The rim 362 can have a shape that is a top-halve of a torus that can assist with a flow of the product while preventing drippage.

Figure 6:
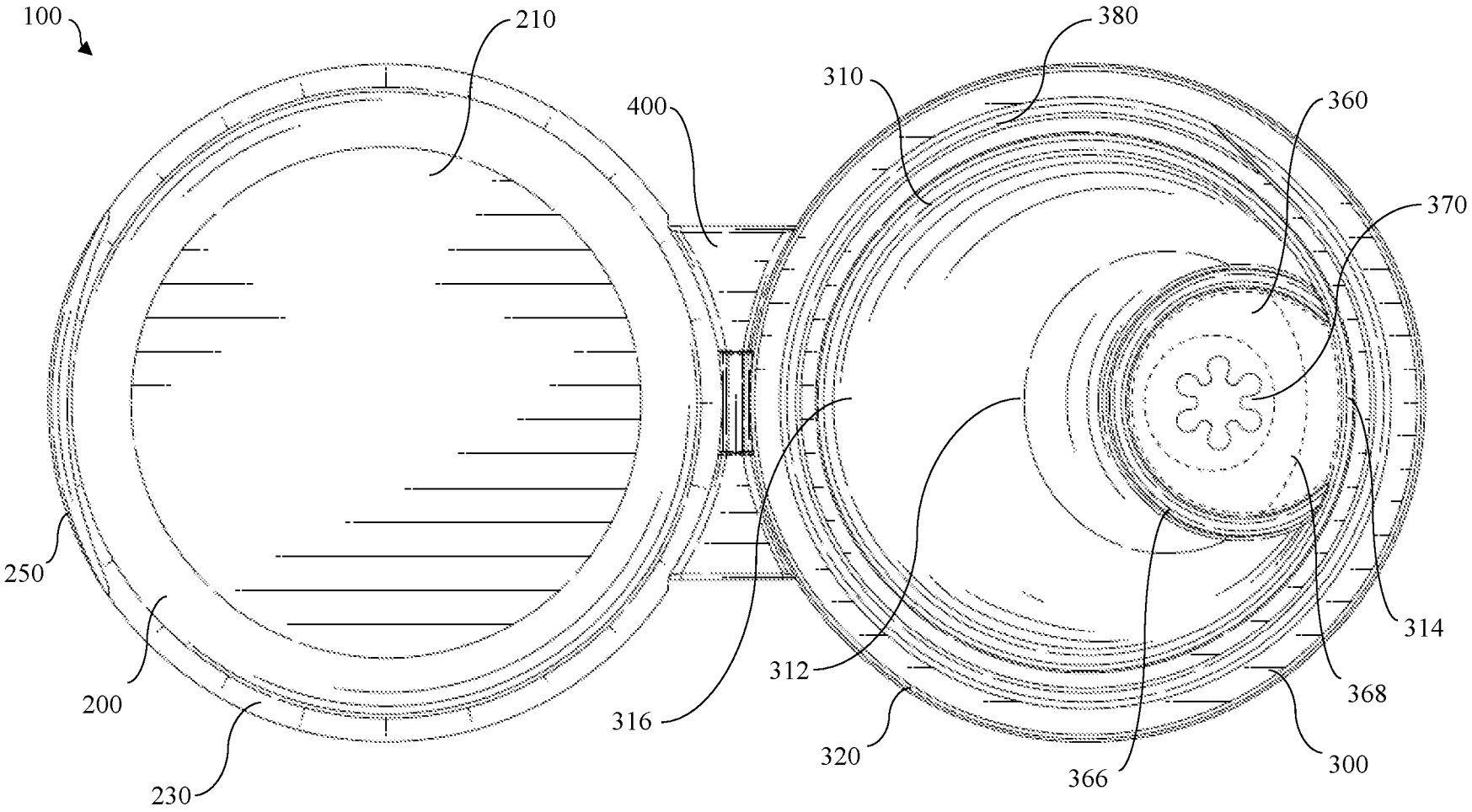
FIG. 6 illustrates a bottom view of the flow control closure of FIG. 1.
Figure 7B:
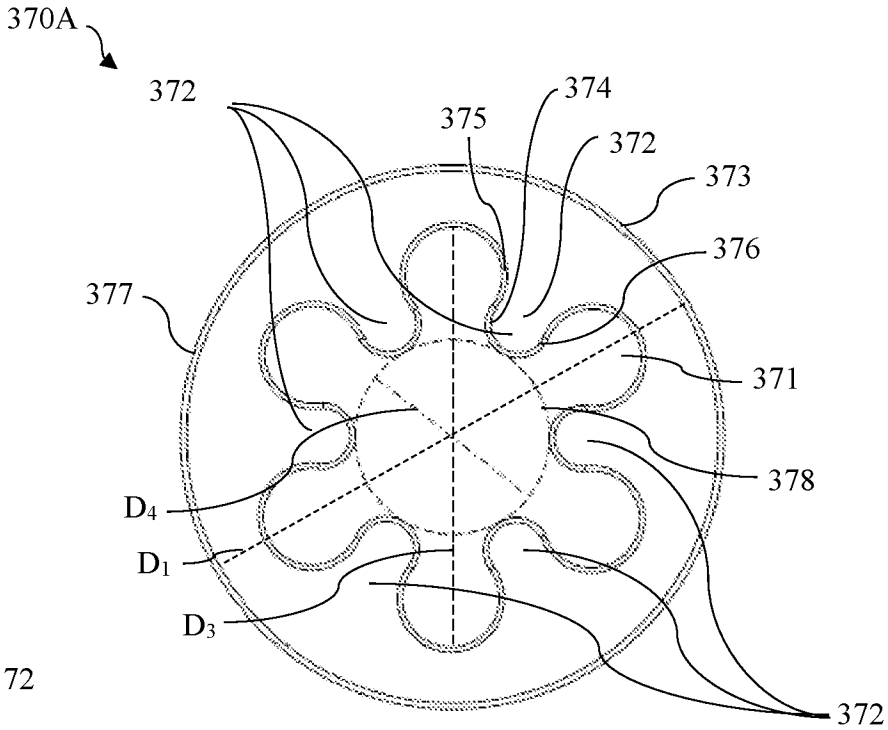
FIG. 7B illustrates a top view of another orifice for the flow control closure of FIG. 1 according to another exemplary embodiment.

As shown in FIGS. 2, 5-7B, the orifice 370 can include one or more uvulas 372. The uvulas 372 can each be in a shape of a curved triangle or a curved trapezoid. For example, in the embodiment shown in FIGS. 7A and 7B, each uvula 372 can include a first convex side 373, a second convex side 374, a first concave side 375, and a second concave side 376, which together form a curved trapezoid. As shown in FIGS. 7A and 7B, the first convex side 373 of each uvula 372 together form an outer profile 377 of the orifice 370. Further, the second convex side 374 of each uvula together form an inner profile 378 of the orifice 370. The inner profile 378 can be formed by an imaginary line, such that the uvulas 372 need not be connected with one another proximal to the inner profile 378. In other embodiments, the uvulas 372 can be of shapes such that the inner profile 378 is formed by consecutive sides of the uvulas 372.

Figure 7A:
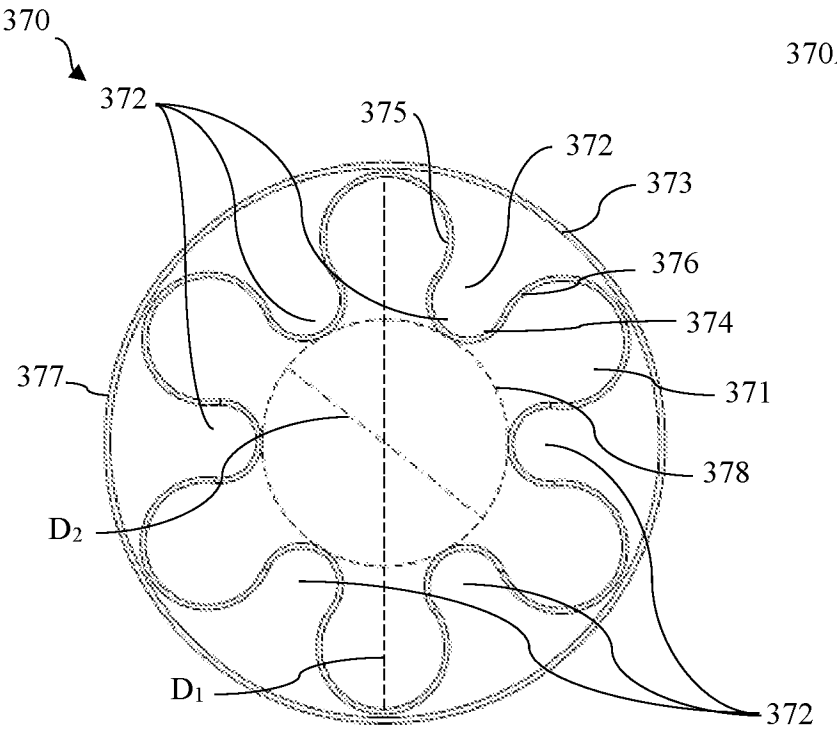
FIG. 7A illustrates a top view of an orifice for the flow control closure of FIG. 1 according to an exemplary embodiment.
Figure 8A:
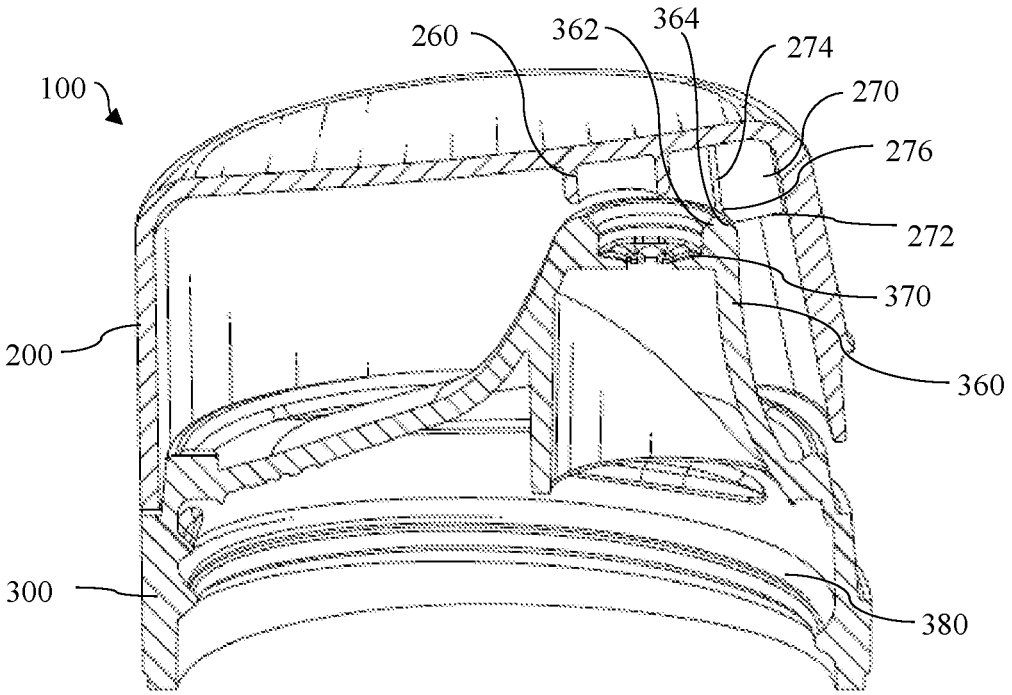
FIG. 8A-8D illustrate cross-sectional view of the flow control closure of FIG. 1 as it traverses from an open configuration to a closed configuration.
Figure 8B:
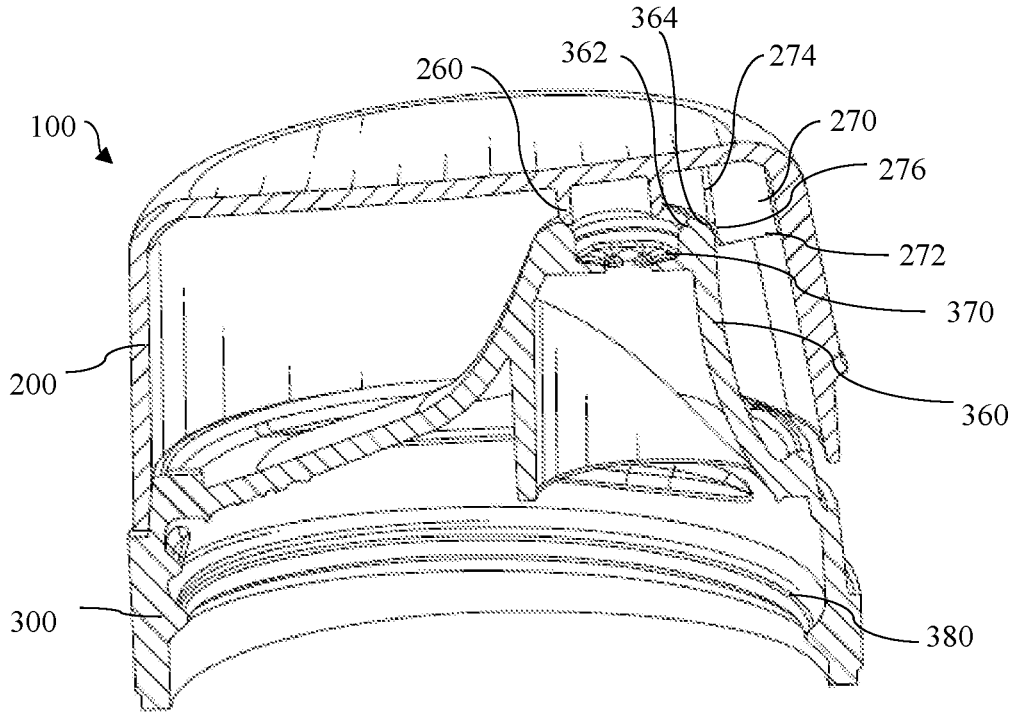
Figure 8C:
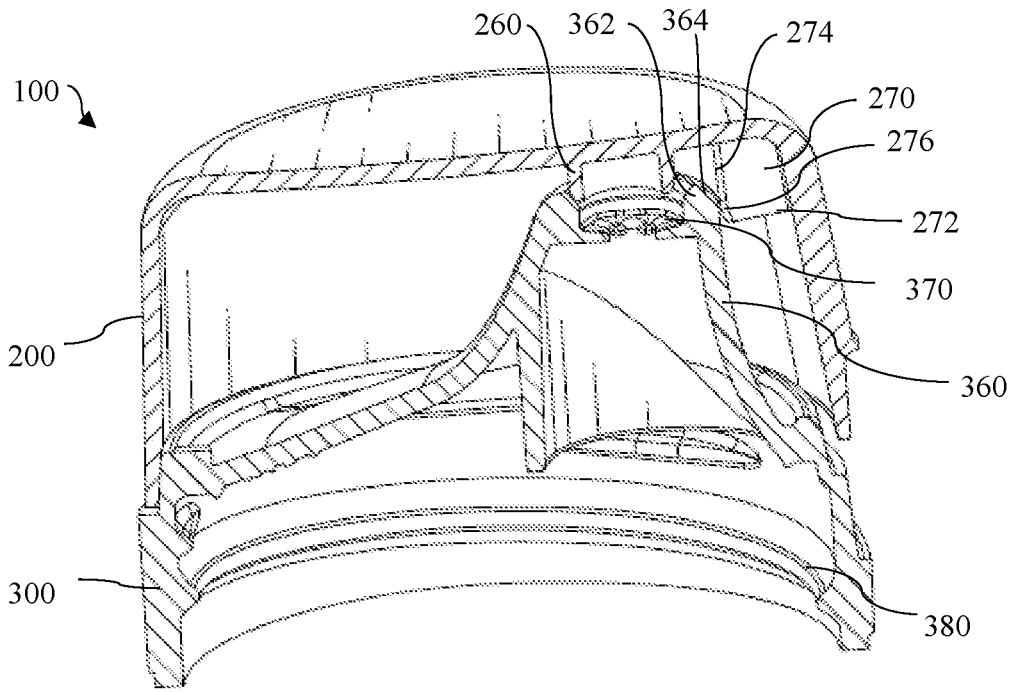
Figure 8D:
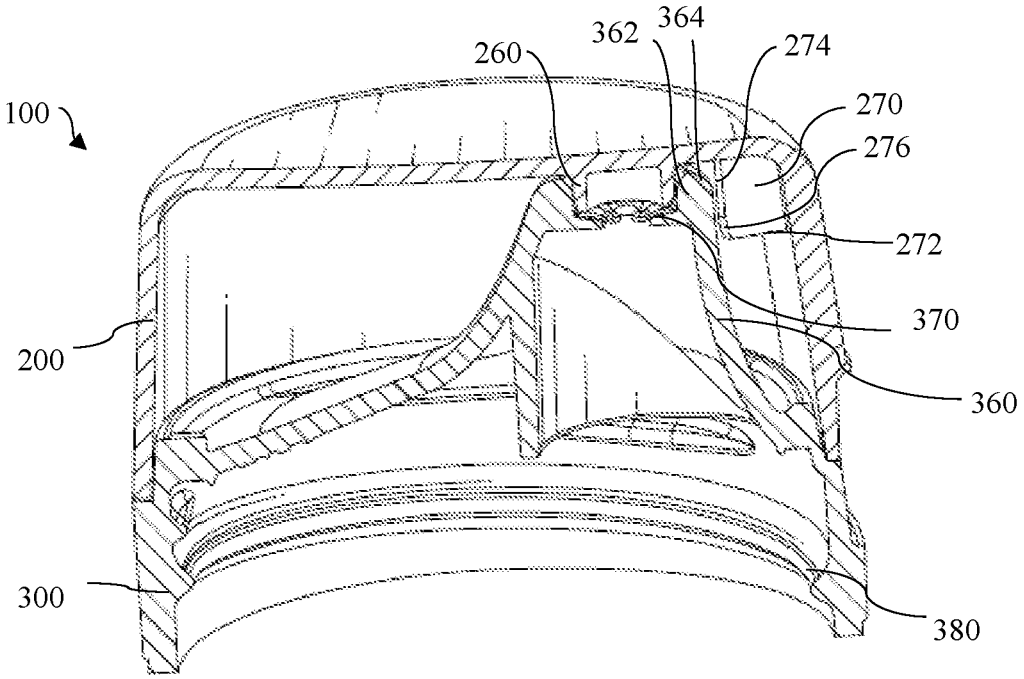

In the specific embodiment shown in FIGS. 7A, the outer profile 377 together with the inner profile 378 can be shown in two concentric circles, with the outer profile 377 having a first diameter $D_1$ that is different from a second diameter $D_2$ of the inner profile 378. In this example, the first diameter $D_1$ can be larger than the second diameter $D_2$. In other embodiments, the inner profile 378 and/or the outer profile 377 of the orifice 370 need not be in a shape of a circle; other geometrical shapes such as a square, a rectangle, a triangle, or the like can also be employed.

As shown in FIG. 7A, the first diameter $D_1$ can be partially obstructed by the uvulas 372, whereas the second diameter $D_2$ can remain unobstructed. By having multiple distinct diameters, $D_1$, $D_2$, the orifice 370 can enhance dispensing control and can create an improved draw-back effect when the flow of the product is stopped, such as when the user relaxed squeeze of the container, resulting in more effectively pulling the product back inward.

FIG. 7B illustrates an orifice 370A according to an additional exemplary embodiment. The primary difference being a geometry of the uvulas 372 with respect to the outer profile 377 of the orifice 370A. In this exemplary embodiment, uvulas 372 are biased toward a center of the orifice 370A. Here, the first diameter $D_1$ is completely obstructed by the uvulas 372 until at least the third diameter $D_3$. Therefrom, the third diameter $D_3$ can be partially obstructed by the uvulas 372, whereas the fourth diameter $D_4$ can remain unobstructed.

As can be appreciated, additional distinct diameters can also be created—either through modifying shapes of the uvulas 372 and/or through other means—and are within the scope of this disclosure. Further, in certain embodiments, the uvulas 372 can be omitted, resulting in the orifice 370 having one single opening and diameter.

When the closure 100 is in the closed position (as shown in FIG. 3), the seal 260 can engage the rim 362 so that the orifice 370 is sealed by the seal 260 to prevent the product from leaking out of the closure 100. In some embodiments, a shape of the seal 260 can correspond to the outer profile 377 of the orifice; thus, only one seal 260 is needed to seal the orifice 370 despite the orifice 370 having multiple distinct diameters therein (such as configurations shown in FIGS. 7A and 7B). In addition, the seal 260 can be used with different configurations of the orifice 370 so long as the outer profile 372 remains generally unchanged, which can reduce design and manufacturing cost.

In some embodiments, when the closure 100 is in the closed position, the bottom edge 264 of the seal 260 can abut or be proximal to the uvulas 372 to provide enhanced sealing. In certain embodiments, when the closure 100 is in the closed position, the top edge 262 of the seal 260 can be flush with a horizontal plane defined by the highest point of the rim 362.

In embodiments where the spout 360 is forwardly skewed, the guide lug 270 can be used to align the lid member 200 with the body member 300 when the closure 100 is transitioning from the open position to the closed position. Referring to FIGS. 8A-8D, when transitioning from the open position to the closed position, the lid member 200 approaches the body member 300 at an angle until the horizontal surface 272 and/or the transitional surface 276 of the guide lug 270 abut the rim 362. Therefrom, the user can apply a lateral force to drag the lid member 200 slightly forward, until the vertical surface 274 of the guide lug 270 clears a front edge 364 of the rim 362, such that the user can apply additional vertical force to close the closure 100, thereby completing the transition from the open position to the closed position. The interaction of the horizontal surface 272 and the transitional surface 276 of the guide lugs 270 together with the rim 362 serve to align the lid member 200 properly into the body member 300, ensuring that the seal 260 can properly seal the orifice 370.

In some embodiments, the guide lugs 270 can omitted if alignment can be achieved without the aid of the guide lugs 270. For example, in the double-wall configuration, where the front edge 364 of the rim 362 is distanced from a vertical plane defined by the forward-most point of base skirt 320, the seal 260 can be positioned such that the seal 260 engages the spout 360 with alignment happening naturally during the transition of the closure 100 from the open position to the closed position. Similarly, in embodiments where the orifice 370 is more centrally positioned relative to the base wall 310, the guide lugs 270 can omitted if alignment can be achieved without the aid of the guide lugs 270.

In certain embodiments, a spout wall 366 can be provided in an underside of the body member 300 (as shown in FIG. 6). The spout wall 366 can form a tunnel 368 that allows the product to flow through and be dispensed out of the orifice 370. The tunnel 368 can be of a different shape than the spout 360. For example, the spout 360 can be of a skewed funnel when viewed from above the body member 200, whereas the tunnel 360 can be an un-skewed funnel or reduced-skew when viewed from the underside of the body member 200.

The hinge member 400 can join the lid member 200 with the body member 300. In some embodiments, the hinge member 400 can join a rear end of the body skirt 320 with a front end of the lid skirt 220. In certain embodiments, the hinge member 400 can be positioned toward a proximal to the body shoulder 330 on the body member 300, and distal from the lid shoulder 230 on the lid member 200. The hinge member 400 can be made of various types of hinges, one of which is discussed in U.S. Pat. No. 10,336,512, titled "Closure System With Hinge Having Uniform Thickness And Elevated Center", which is hereby incorporated by reference in its entirety.

The hinge member 400 can be flexible, permitting the lid member 200 to have slight lateral movements when a generally lateral force is applied on the lid member 200. When the closure 100 transitions from the opening position to the closed position, the lid member 200 pivots among an axis A defined by the hinge member 400 toward the body member 300. The lateral movements can allow the guide lugs 270 to be dragged across the rim 362 toward the front edge 364 while dragging the seal 260 into the spout 360 when the guide lugs 270 abut the rim 362. Further, when the user cease to apply the lateral force after closing the closure 100 (as shown in FIG. 3), the hinge member 400 can spring backward—away from a vertical plane defined by the top ledge 250 and the bottom ledge 350—pulling the lid member 200 laterally against the body member 300, ensuing that the closure 100 remains in the closed position unless otherwise open by the user.

In embodiments with increased hinge distance where the orifice 370 is at a further distance from the hinge member 400, the guide lugs 270 can be omitted due to a larger swing arc by the lid member 200 as it encroaches upon the body member 300. The larger swing arc can result in a more gradual approach angle, allowing the seal 260 to enter the spout more easily 360 without needing the guide lugs 270 for alignment. Such embodiments can be deployed in the double-wall configuration given the orifice 370 is typically further away from the hinge member 400 than in a single-wall configuration. For example, in embodiments where the hinge distance (as measured from the axis A to the orifice 370) is more than twice than a height of the spout 360 (as measured from the base wall 310 to the top of the rim 362), the guide lugs 270 may be omitted.

In some embodiments, the closure 100 can be molded using one single material, creating one unitary piece. Suitable materials for molding the closure 100 can include plastics, such as high-density polyethylene, low-density polyethylene, polypropylene, or the like. The unitary one-piece nature can reduce manufacturing cost of producing the closure 100, while allowing the entire closure 100 to be recyclable.

Specific embodiments of a flow control closure according to the present invention have been described for the purpose of illustrating the manner in which the invention can be made and used. It should be understood that the implementation of other variations and modifications of this invention and its different aspects will be apparent to one skilled in the art, and that this invention is not limited by the specific embodiments described. Features described in one embodiment can be implemented in other embodiments. The subject disclosure is understood to encompass the present invention and any and all modifications, variations, or equivalents that fall within the spirit and scope of the basic underlying principles disclosed and claimed herein.

What is claimed is:

1. A closure apparatus comprising:

a body member comprising a base wall, a body skirt, and a spout extending from the base wall away from the body skirt;

a lid member comprising a top wall and a lid skirt, the lid member being movable between an open position and a closed position, and comprising a guide lug positioned to align the lid member with the body member when the lid member transitions from the open position to the closed position;

the top wall having a seal positioned to engage the spout when the lid member is in the closed position; and a hinge member that joins the lid member with the body member, wherein the base wall includes a back portion proximal to the hinge member and a front portion distal from the hinge member, the spout includes an orifice, and wherein the guide lug comprises a horizontal surface that is parallel to the top wall, wherein the horizontal surface of the guide lug is positioned to contact the top rim of the spout when the lid member transitions from the open position to the closed position.

2. The closure apparatus of claim 1, wherein the orifice comprises an outer profile having a first diameter and an inner profile having a second diameter that is different from the first diameter.

3. The closure apparatus of claim 2, wherein the orifice comprises at least one uvula, and the first diameter of the orifice being partially obstructed by the at least one uvula.

4. The closure apparatus of claim 3, wherein the second diameter of the orifice remains unobstructed by the at least one uvula.

5. The closure apparatus of claim 3, wherein the seal abuts the at least one uvula when the lid member is in the closed position.

6. The closure apparatus of claim 2, wherein a size of the seal corresponds to the outer profile of the orifice.

7. The closure apparatus of claim 1, wherein the spout extends from the base wall from a middle portion of the base wall to the front portion of the base wall, the spout is skewed funnel shaped with the orifice biased toward the front portion of the base wall.

8. The closure apparatus of claim 1, wherein the lid member, the body member, and the hinge member are molded as one unitary piece.

9. A closure apparatus comprising:

a body member comprising a base wall, a body skirt, and a spout extending from the base wall away from the body skirt;

a lid member comprising a top wall and a lid skirt, the lid member being movable between an open position and a closed position, and comprising a guide lug positioned to align the lid member with the body member when the lid member transitions from the open position to the closed position; and the top wall having a seal positioned to engage the spout when the lid member is in the closed position; and a hinge member that joins the lid member with the body member, wherein the base wall includes a back portion proximal to the hinge member and a front portion distal from the hinge member, the spout includes an orifice, wherein the orifice comprises an outer profile having a first diameter and an inner profile having a second diameter that is different from the first diameter, the orifice further comprises at least one uvula, and the first diameter of the orifice being partially obstructed by the at least one uvula;

and wherein the guide lug comprises a horizontal surface that is parallel to the top wall, wherein the horizontal surface of the guide lug is positioned to contact the top rim of the spout when the lid member transitions from the open position to the closed position.

10. The closure apparatus of claim 9, wherein the seal abuts the at least one uvula when the lid member is in the closed position.

11. The closure apparatus of claim 9, wherein a size of the seal corresponds to the outer profile of the orifice.

12. The closure apparatus of claim 9, wherein the spout extends from the base wall from a middle portion of the base wall to the front portion of the base wall, the spout is skewed funnel shaped with the orifice biased toward the front portion of the base wall.

13. The closure apparatus of claim 9, wherein the lid member, the body member, and the hinge member are molded as one unitary piece.

14. A closure apparatus comprising:

a body member comprising a base wall, a body skirt, and a spout extending from the base wall away from the body skirt;

a lid member comprising a top wall and a lid skirt, the lid member being movable between an open position and a closed position, the top wall having a seal positioned to engage the spout when the lid member is in the closed position, the lid member further comprises a guide lug positioned to align the lid member with the body member when the lid member transitions from the open position to the closed position, wherein the guide lug comprises a horizontal surface that is parallel to the top wall, and the horizontal surface of the guide lug is positioned to contact a top rim of the spout when the lid member transitions from the open position to the closed position; and a hinge member that joins the lid member with the body member, wherein the base wall includes a back portion proximal to the hinge member and a front portion distal from the hinge member, the spout includes an orifice, wherein the orifice comprises an outer profile having a first diameter and an inner profile having a second diameter that is different from the first diameter, the orifice further comprises at least one uvula, and the first diameter of the orifice being partially obstructed by the at least one uvula.

15. The closure apparatus of claim 14, wherein the spout extends from the base wall from a middle portion of the base wall to the front portion of the base wall, the spout is skewed funnel shaped with the orifice biased toward the front portion of the base wall.

16. The closure apparatus of claim 14, wherein the lid member, the body member, and the hinge member are molded as one unitary piece.

* * * * *